US006214194B1

(12) United States Patent
Isenberg

(10) Patent No.: US 6,214,194 B1
(45) Date of Patent: Apr. 10, 2001

(54) PROCESS OF MANUFACTURING LAYERS OF OXYGEN ION CONDUCTING OXIDES

(75) Inventor: Arnold O. Isenberg, 327 Woodside Rd., Pittsburgh, PA (US) 15221

(73) Assignee: Arnold O. Isenberg, Pittsburgh, PA (US)

( * ) Notice: Subject to any disclaimer, the term of this patent is extended or adjusted under 35 U.S.C. 154(b) by 0 days.

(21) Appl. No.: 09/435,145

(22) Filed: Nov. 8, 1999

(51) Int. Cl.[7] ..... C25D 3/66

(52) U.S. Cl. ..... 205/230; 205/333; 205/538; 205/542; 205/88; 205/161; 205/316

(58) Field of Search ..... 205/230, 333, 205/538, 542, 88, 161, 316

(56) References Cited

U.S. PATENT DOCUMENTS 4,430,170 * 2/1984 Stern ..... 204/39

4,773,973 * 9/1988 Gruniger et al. ..... 204/39

* cited by examiner

*Primary Examiner*—Kathryn Gorgos
*Assistant Examiner*—Christopher M. Keehan
(74) *Attorney, Agent, or Firm*—Klaus J. Bach

(57) ABSTRACT

The electrochemical formation of oxygen ion conducting solid oxide layers is achieved by the cathodic deposition of the oxide layers from a melted salt bath of alkali element halides containing dissolved metal halides which provide the metal cations from which oxide layers are formed and attached to conductive cathodes. Oxygen is supplied at the cathodes to form oxygen ions which diffuse through the cathodically formed oxide layers and react with dissolved metal cations leading to oxide layer growth. The dissolved metal halides are regenerated at the anodes from metals and metal compounds. The process is called cathodic oxide deposition (COD) and represents a new and economic method for the fabrication of oxygen ion conductor layers for solid oxide electrochemical devices.

33 Claims, 5 Drawing Sheets

PROCESS OF MANUFACTURING LAYERS OF OXYGEN ION CONDUCTING OXIDES

BACKGROUND OF THE INVENTION

1. Field of the Invention

The present invention relates to the fabrication of layers of solid oxides which have the ability to support the flow of electricity by the diffusion of oxygen ions through the crystal lattice of the oxides. Such oxides are the basis for the technology of solid state electrochemical devices such as solid oxide fuel cells (SOFC), oxygen gas separators, oxygen gas generators, electrolyzers for water vapor and carbon dioxide, and oxygen sensors for combustion control in power generation as well as in automotive internal combustion engine control. SOFCs are devices which produce direct current (DC) electrical energy in the most efficient way known, they are under development by companies and government agencies of most industrialized nations. SOFC generators in the size of hundreds of kilowatts have been built and successfully tested for thousands of hours. The electrochemical cells which make up the SOFC generators are based on the oxygen ion conduction of thin oxide layers of rare earth-element-stabilized zirconium oxide (zirconia) as the electrolyte. Yttria-stabilized zirconia (YSZ) is widely used in many of the electrochemical device applications mentioned above. Oxygen ($O_2$) can be separated from air or other gas mixtures and produced in pure form by the application of a DC current between electrodes attached to gas-impervious YSZ layers which separate the $O_2$ containing gas mixture from pure $O_2$. The transport of oxygen from one electrode to the other is supported by the flow of oxygen ions through the gas impervious YSZ electrolyte layer.

Water vapor and carbon dioxide can be decomposed electrochemically in solid oxide electrolysis cells (SOECs) similarly by the application of an external DC power supply in order to produce pure oxygen, hydrogen, and carbon monoxide, respectively. With oxygen sensors one measures the voltage between electrodes of similar, but much smaller, cell configurations only. In this application one electrode is exposed to an oxygen source of known concentration such as air while the other electrode is exposed to the unknown concentration, for instance, of a combustion chamber. The resulting cell voltage is a thermodynamically precise measure for the unknown oxygen concentration.

The described devices use solid oxide electrolyte layers that are nearly pure oxygen ion conductors. YSZ is only one oxide in this group of oxides. Doped cerium oxide (ceria), doped hafnium oxide (hafnia), doped bismuth oxide, and doped lanthanum gallate are further examples for pure oxygen ion conductors that find application as electrolytes in solid oxide electrochemical cells.

Another group of oxides conducts electrical current by oxygen ion diffusion as well as by electrical charges such as electrons or positive holes. Such oxides are called mixed conducting, oxygen-ionic/electronic, conductors. These oxide conductors are also used for electrochemical devices since they allow for oxygen mass transport through the bulk of the solid oxide via ionic as well as electronic charges. A potential application of such oxides is in the form of semipermeable membranes which can be used for oxygen separation from other gases. However, in contrast to the formerly mentioned SOECs, the semipermeable membrane cells require no electrodes and DC power supply. This type of membrane-cell operates by the application of an oxygen gas pressure differential across the membrane which affects oxygen transport through the otherwise structurally dense membrane, resulting in the generation of pure oxygen at the low pressure side of the membrane. These devices are under intense investigation because they offer a new cost effective and efficient method to produce pure oxygen.

Mixed conducting, oxygen-ionic/electronic, oxides are also used in porous layers as electrodes or parts of electrodes in other solid oxide electrochemical cells, such as SOFCs and SOECs, because they allow the achievement of higher current densities and, therefore, reduce cell voltage losses.

Other applications of mixed conducting oxide cell membranes have been proposed for selective oxidation of olefins to achieve a more selective yield of desired chemicals, whereby the mixed conducting oxide membrane controls the oxygen transfer to the organic reactant for selective oxidation.

Both types of electrochemical cells, those with pure ionic electrolytes and electrodes, and those with mixed conducting. oxygen-ionic/electronic membranes without electrodes, are investigated as oxygen generators for life support systems in medical technology, as well as, in aeronautical and space applications.

All devices in the field of this invention operate at elevated temperatures, usually between 300° C. and 1000° C., in order to increase the oxygen ion conductivity of the oxides to useful levels for the desired device operation. The electrical cell resistance is reduced by an increase of the operating temperature of devices because the rate of oxygen ion transfer is increased. An important method, however, for increasing the oxygen transfer rates and current densities in solid oxide devices is the reduction of the thickness of the oxygen ion conducting layers. To achieve this in an economical way is a technological challenge and is the objective of this invention.

2. Description of the Prior Art

The predominant methods and processes to produce the thin and conductive oxide layers for solid oxide electrochemical devices as described in the section: Field of the Invention, can be divided into three categories, namely, powder sinter methods, thermal spay processes, and electrochemical vapor deposition (EVD). The latter process is the most successful one in SOFC technology. EVD is a high temperature process where metal halide vapors react with oxygen in an electrochemical way, whereby the desired reaction product, namely the oxygen ion conductor, is produced as a thin gas-impervious oxide layer of approximately 5 to 50 micrometers, which is deposited onto a suitable support structure for mechanical stability. Thermal spray and sinter methods are best suited for thicker layers.

The process of EVD was first published in Proceedings, ECS—Symposium, Electrode Materials and Processes for Energy Conversion and Storage, 1977, Vol.77-6, pp 572–583 (A. O. Isenberg). The publication describes the basic elements of a vacuum EVD process for making thin layers of oxygen ion conducting oxides such as YSZ and gadolinia doped ceria, and of the mixed conducting complex oxide lanthanum chromite.

U.S. patent application Ser. No. 08/882,579 (A. O. Isenberg) teaches a much improved EVD process that allows the deposition of oxygen ion conducting oxide layers at pressures below or near atmospheric pressure and with the capability to achieve the deposition of more complex compositions for mixed conducting, oxygen-ionic/electronic, oxides through the use of zinc metal vapors as one of the reactants in the deposition zone.

U.S. Pat. No. 4,791,079 (E. A. Hazbun) teaches the formation of mixed conducting oxide layers by EVD for the fabrication of membranes for hydrocarbon oxidation and dehydrogenation processes.

U.S. Pat. No. 3,525,646 (H. Tannenberger et al.) teaches the use of a plasma torch to fabricate solid oxide electrolyte layers for SOFCs.

U.S. Pat. No. 3,402,230 (D. W. White, Jr.) teaches powder coating of stabilized zirconia followed by a sinter process to form the solid oxide electrolyte layers for SOFCs.

The publication "Oxygen Permeability and Phase Transformation of $Sr_{0.9}Ca_{0.1}CoO_{2.5+d}$" (N. Miura et al.), Journal of The Electrochemical Society, 146 (7) 2581, teaches the fabrication of sintered, mixed conducting, oxygen-ionic/electronic, oxides and the method of measuring oxygen gas permeation through sintered oxide membrane disks.

Mixed conducting, oxygen-ionic/electronic, oxides can be found abundantly in the family of oxides called perovskites of the general formula $ABO_3$. The crystal structure of perovskites allows for extensive doping of the host elements in A and B sites. As a consequence, one can vary the electronic as well as the oxygen-ion conductivities in relatively wide ranges. It is, therefore, not surprising that large numbers of oxide compositions can be claimed as useful materials for oxygen separation and transport devices. Lanthanum strontium ferrite, a perovskite material, has been investigated in the form of sintered membranes as reported by J. E. ten Elshof et al. in Solid State Ionics, 81,97 (1995).

All the processes for forming thin layers of oxygen ion conductors for solid oxide electrochemical devices as presented above, which have been taught in patents and the technical literature, have significant shortcomings, which stem from processes not being fully developed because of expensive equipment needs, and also because of inherent characteristic flaws of some of the processes.

The EVD process produces a high quality oxide layer product, but a low reactant utilization makes reactant recovery through chemical processing a necessity. Also, reactant streams are corrosive and reactor temperatures are high, which leads to increased capital cost.

The thermal spray process is wasteful in the use of relative expensive powders of oxides and as-sprayed layers are not free of open porosity. A major problem is the fact that the composition of many complex oxides is altered through selective oxide evaporation at the extremely high temperatures, which makes it difficult to achieve reliable compositions of highly doped, mixed conducting oxides in the perovskite family of oxides.

The sinter process, while efficient with respect to process yields, requires very close control of powder materials in order to achieve impervious layers reliably; also, it is difficult to achieve thin layers below 100 micrometers reliably in the desirable device form, namely, tubes and channels. The sinter process is sensitive to powder contamination, oxide interaction with sinter supports, and with furnace atmosphere; like the thermal spray process, it can lead to compositional variations because of selective oxide evaporation at high sinter temperatures. The shortcomings of these processes are, in part, responsible for the fact that electrochemical oxygen ion conducting oxide devices have not achieved their technological potential.

This invention resides in a new process that allows the deposition of oxide layers consisting of pure oxygen ion conductors as well as that of layers of mixed conducting, oxygen-ionic/ electronic, oxides. The process allows the fabrication of such layers at temperatures as low as 400° C. or even lower and at a reactant utilization that is near theoretical and that is at a level of 90% or higher. The process has the capability of producing thin layers having thickness of only a few micrometers as a low limit.

SUMMARY OF THE INVENTION

It is the objective of this invention to provide a method for the deposition of oxygen-ion conducting oxide layers which eliminates the negative aspects of the known processes as much as possible and to produce such oxide layers commercially. The process achieves this goal to a high degree. It operates at or near atmospheric pressure, at low to medium temperatures, preferably in the range of 350° C. to 500° C. but it is not limited to this range. The process is usefull for the deposition of pure oxygen-ionic oxide conductors as well as for mixed conducting, oxygen-ionic/electronic, oxides in the form of layers of a few micrometer in thickness, or thicker, over porous and dense support structures. The process is an electrochemical one and is called cathodic oxide deposition (COD).

The process of COD is made possible by the very nature of oxygen ion conductors, namely, that of oxygen ion transport. The process is limited only by the rate of oxygen ion transport of a particular oxide at a given temperature. An external DC power supply is used to control the oxygen ion transport through the growing oxide layer, however within the limits of the oxygen ionic and electronic conductivity of the respective oxide. Metal cations required for the formation of the desired oxygen ion conducting oxide compositions are supplied to the actual oxide deposition zone in relative low concentrations as dissolved halides, preferably, in a eutectic melt of potassium chloride and lithium chloride. The oxide deposition takes place at the negative electrode, or cathode, in the electrochemical bath of the melted alkali metal salts. The anode is composed of various compounds that serve the purpose of replenishing the cationic elements that are lost from the molten salt bath for the oxide deposition.

The supply of oxygen at the cathode can be provided by oxides or oxide mixtures that are contained at the cathode and which donate all or part of their oxygen to the oxide growth process for the oxygen ion conductor. Oxygen can also be provided to the cathode in the form of oxygen gas as well as oxygen which is contained in gaseous compounds such as, water vapor ($H_2O$), carbon dioxide ($CO_2$), nitrogen oxides (NO, $N_2O$), and sulfur dioxide ($SO_2$). Such gaseous oxygen reactants are supplied to the cathode of the molten salt oxide deposition cell by designing the cathode as a porous gas diffusion electrode. This gas diffusion electrode design is very accommodating to the need of having the thin oxide layers deposited onto porous substrates as mechanical support and for a favorable geometry of devices for operation, preferably in tubular or channel type form.

The eutectic melt of the potassium chloride (KCl) and lithium chloride (LiCl) is not corrosive to most oxide materials which are under consideration as oxygen ion conducting layers or their support structures, since the alkali metal chlorides are thermodynamically very stable compounds. A melt composition of 42 mol % potassium chloride and 58 mol % lithium chloride, which melts near 350° C., is considered as the preferred solvent for the cationic reactants which are also, preferably, in the form of metal chlorides. It is obvious that other halides such as fluorides, bromides, and iodides can be used as solvents also, and also as cation replenishment halides. Mixtures of fluorides, chlorides, iodides, and bromides are viable alternatives when thermodynamic considerations for the growth and chemical stability of a desired oxide make the use of such mixtures desirable. Potassium chloride/lithium chloride melts (PLCM) are the preferred solvents for the COD process, from process cost considerations. This solvent is considered as a representative for all other alkali metal halide and earth alkali halide type solvents, involving fluorides, bromides, iodides, chlorides, and mutual mixtures of individual halides or mixtures of all halides in various concentrations.

During COD processing the cathodes are submersed in the PLCM, they are the mechanical support for the thin deposited oxygen ion conducting oxide layers. During the submersed state some PLCM may be included in pores of the cathodes. The inclusion of PLCM in pores can take place before the growing oxide layer has closed the cathode surface with a continuous oxide layer. The trapped PLCM can be removed by a subsequent water leaching operation. The elements lithium and potassium are easily recovered near 100% and at a low cost by ion exchange of the PLCM water solution on suitable ion exchange resins. The water leaching process is fast and efficient for a porous cathode because of the high water solubility of PLCM and the large open porosity of most of the cathode support structures. The oxide layers and cathode supports are not affected by the leaching process if their composition is stable with respect to hydrolysis. Since the chemical stability of the desired oxygen ion conducting oxides in humid atmospheres is an a priori requirement for essentially all solid oxide oxygen ion conducting devices, hydrolysis of oxides due to the PLCM leaching process is not a problem.

There are five major reasons for the choice of the PLCM solvent bath which are: 1. It provides precise control of the concentration of the dissolved cation species for control of the phases of oxide deposit nucleation and scale growth. 2. It maximizes the dissociation of the dissolved metal halides for the transport of ions to the cathode and anode. 3. The PLCM reduces the vapor pressure of dissolved metal halides like zirconium tetrachloride, hafnium tetrachloride, titanium tetrachloride, iron trichloride, and other transition element halides to low levels, which then are easily controlled with little technical complications in an enclosed inert gas atmosphere, such as nitrogen or argon. 4. The temperature of the PLCM electrolyte bath is so low that inexpensive materials can be used for containment vessels and thermal insulation. 5. The COD process can be executed as a continuous or batch type process, and at a low cost.

After oxide layer deposition, the cathode structures with the firmly attached layers of oxygen ion conducting oxides, are cooled to room temperature and, subsequently, are undergoing the water leaching process to remove trapped PLCM followed by forced air drying of the porous oxide layer supports.

The rate of oxide deposition on cathodes is controlled by four major parameters. 1. The PLCM bath temperature, 2. the cell driving voltage and current which are controlled by an external power supply, 3. the oxygen ion conductivity of the desired oxide deposit, and, 4. the concentration of dissolved cationic species of elements in the PLCM that make up the oxide deposit. All four parameters influence each other and must be determined individually for any given oxide in order to achieve optimal process conditions.

Cathodes must exhibit sufficient electronic conductivity to support the current that is required for the oxide scale growth. This is not a problem for most solid oxide electrochemical devices because most oxide layer support structures fulfill the function of electrodes for the devices. If the COD process is to be applied to electrically insulating structures one must find methods to make their surfaces sufficiently electronically conductive which can be achieved by the incorporation of oxygen donating reactants into the porosity of the insulating material and, if necessary by additional metallizing with gold, silver, copper, platinum group metals, and other transition element metals.

Oxygen donating reactants, which can be incorporated into the porosity of electronically conductive or insulating support structures, and which provide the oxygen for the growth of the oxygen ion conducting oxide layers, are the oxides of transition element metals. Such as copper oxides, $Cu_2O$, CuO; nickel oxide, NiO, iron oxides, FeO, $Fe_2O_3$, $Fe_3O_4$; manganese oxides, $MnO_2$, $Mn_2O_3$, $Mn_3O_4$; cobalt oxide, CoO; zinc oxide, ZnO; palladium oxide, PdO; chromium oxide, $Cr_2O_3$; indium oxide, $In_2O_3$; and especially praseodymium oxides of the formula $Pr_{6-x}O_{11-y}$ are preferred oxygen donating oxides, wherein x and y of the formula symbolize a large number of transitional oxide stages with loss of oxygen from the crystal lattice accompanied by valence changes of praseodymium.

The relative massive porous oxide layer support structure of the cathode itself can be a source of oxygen for the growing oxygen ion conducting oxide layer, especially if the support structure is made from oxides of the group of perovskites.

The growth of the oxygen ion conducting oxide layers over conductive cathode support structures depends on sufficient oxygen ion conduction of the deposited oxides at temperatures as low as 300° C. and higher and both, pure and mixed conducting oxygen ion conductors, can be deposited equally well by COD. The most common pure oxygen ion conductor compositions are based on host oxides such as zirconia, ceria, and hafnia, which are doped with rare earth element oxides. Mixed conducting, oxygen-ionic/electronic, oxides, are found mostly in the group of complex oxides having the perovskite crystal structure, and having compositions which consist of rare earth elements, in combination with alkaline earth elements and transition elements.

The COD process consists of two phases. Phase I is of short duration and consists of simultaneous chemical and electrochemical reactions between the oxygen donating oxides or gas mixtures at the cathode with the metal halides that are dissolved in the PLCM, namely, the halides of the metal elements that make up the deposited oxide. During phase I oxide deposition takes place by nucleation and crystal growth resulting in a thin and dense layer which, while being formed, causes the separation of the reaction partners and prevents their direct chemical interaction. When phase I comes to an end, the purely electrochemical phase II of the process sets in. Phase II is mainly controlled by the external DC power supply which enables and controls the transfer of oxygen from the oxygen donating reactants at the cathode, in the form of oxygen ions, through the very thin oxide layer that was formed during phase I reactions. The negatively charged oxygen ions migrate in the DC voltage gradient through the thin oxygen ion conducting oxide layer in the direction toward the positive anode and react electrochemically at the oxide/PLCM interface with the dissolved metal halides causing thickness growth of the oxide layer.

The electrochemical reaction at the anode involve reactions of negative halide ions with reactive metals, metal oxides or metal oxyhalides in mixtures with carbon, to form the required metal halides that have been depleted by the growth of the oxygen ion conducting oxide layers. The anodically replenished metal halides dissolve in the PLCM and provide further reactants for continued oxide film growth. The consumption of reactants nearly follows Faraday's Law with respect to oxide growth by oxygen ion transfer through the growing oxide layer at the cathode and reactant regeneration at the anode.

Another important capability of the COD process lies in the fact, that it can be used for the fixation of porous solid matter to oxygen ion conducting oxide layers, whereby the porous layer of metals, metal oxides, and others, are first lightly, but sufficiently, attached to the oxide layer by various techniques such as sinter or spray processes. The lightly attached porous layers are then exposed to the COD process, during which oxide will grow into the porosity of the applied materials layer and attach the latter firmly to the underlaying oxygen ion conducting oxide layer. This method of materials attachment to the oxygen ion conducting oxide layers is practical for the bonding of electrode layers in SOFC, SOEC, and sensor devices.

In a similar way one can use the COD process also for the manufacturing of layers of composite materials that may not necessarily be used in connection with solid oxide electrochemical devices.

The summarized COD process features show that this process uses inexpensive materials, it utilizes reactants at a high yield, it is essentially free of waste streams, it is uncomplicated with respect to process steps and reactor design. The COD process, therefore, represents a unique and economical method for the fabrication of thin oxide layers of pure oxygen ion conductors, as well as for the fabrication of thin layers of oxides that are mixed conducting, oxygen-ionic/electronic, conductors. The process is also useful for the attachment of porous materials to oxygen ion conducting oxide layers which is of great advantage for the firm mechanical bonding of electrodes to solid oxide electrochemical devices.

The invention will become more readily apparent from the following description of various embodiments thereof, shown by way of example only, and in schematic presentation in the accompanying drawings.

BRIEF DESCRIPTIONS OF THE DRAWING

DESCRIPTIONS OF THE PREFERRED EMBODIMENTS

The following descriptive explanation is best accomplished by the description of examples of how the COD process can be executed and by examples of the COD process for the deposition of a YSZ layer, as a representative of pure oxygen ion conductors, over porous structures of doped lanthanum manganite. Doped lanthanum manganite is chosen as a representative material for cathodes which are made from electronically conductive complex oxide compositions, and specifically, as a representative of complex oxide compositions which belong to the large group of mixed conducting, oxygen-ionic/electronic, oxides of the perovskite family. Doped lanthanum manganite is also selected as a representative of mixed conducting, oxygen-ionic/electronic, conducting oxides that can be produced as layers by the COD process. All oxide layers which can be deposited by the COD process, regardless of whether they are pure oxygen ion conducting or mixed conducting, oxygen-ionic/electronic, in character, are described here as the "group of oxygen ion conductors" (GOIC).

Figure 1:
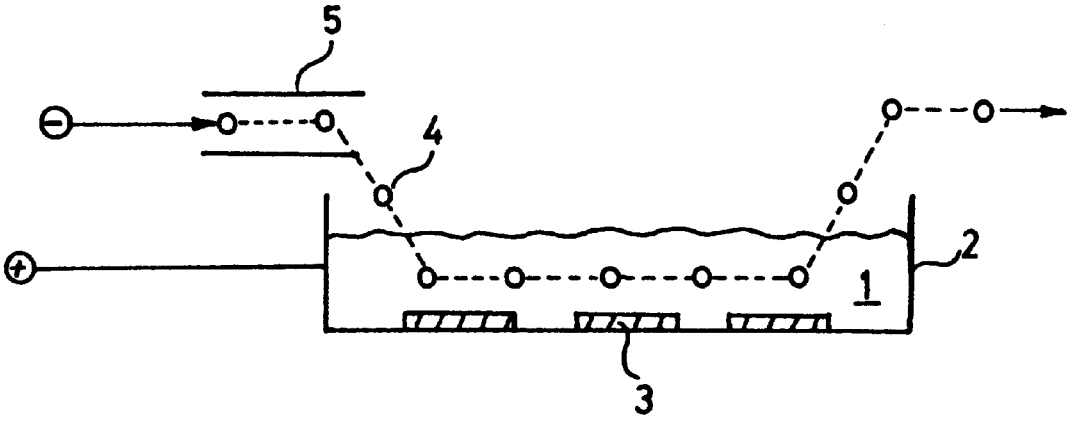
FIG. 1 is a schematic representation of a continuous COD process.
Figure 2:
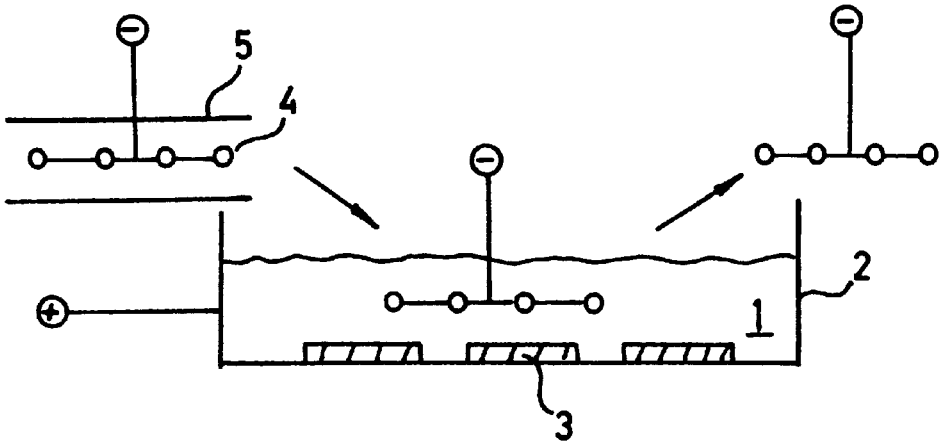
FIG. 2 is a schematic representation of a batch type COD process.

In FIGS. 1 and 2 the essential elements for conducting the COD process in a continuous and batch type fashion, respectively, are shown. An open PLCM electrolyte bath 1 arrangement is used in both processes for easy access. The open electrolyte bath construction facilitates the establishment of a continuous oxide deposition process, as shown in FIG. 1, wherein a PLCM container 2, preferably made of graphite, iron, cobalt, nickel, copper, or selected stainless steel, provides good electrical contact to stationary anode members 3. Multiple cathodes 4 are connected electrically in parallel or in series, and are preheated by heater means 5 before entering and being fully submerged in the PLCM bath The cathodes move laterally through the PLCM bath while oxide deposition takes place onto the cathodes. The cathodes are also continuously removed from the PLCM bath and cooled before being removed from the inert gas atmosphere of the COD reactor. The batch type COD process, depicted in FIG. 2, is characterized by the sequence of first, preheating a batch of electrically parallel or series connected cathodes 4, second, submerging them into the PLCM bath 1 for the duration of the oxide deposition process, third, removing the cathode batch, followed by cooling and removal from the COD reactor containing the PLCM bath mechanism.

The atmosphere in the COD reactor is made up of inert gases which do not contain free oxygen or oxygen containing gaseous compounds that could react chemically with the dissolved metal halides within the salt bath. Nitrogen as well as argon gas are the preferred cover gases. The cover gas pressure within the COD reactor confines is above atmospheric pressure to prevent in leakage of reactive oxygen containing gases. In a case where the oxygen reactants of cathodes release oxygen to the cover gas atmosphere, the cathodes are surrounded by a separate inert gas cover, not shown in FIGS. 1 and 2 until they are submerged quickly into the PLCM bath, in order to minimize oxygen contamination of the cover gas atmosphere in the COD reactor.

The cathodes are usually made in the geometry of the structural members of solid oxide electrochemical devices like SOFCs or SOECs, preferably in the form of tubes or channels. However, they can also be shaped as flat plates in sealed or unsealed forms. The tubular or channel like cathode form is also the preferred geometry for mixed conducting, oxygen-ionic/electronic, oxide membranes. When such cathodes are removed from the deposition reactor and have been leached from trapped PLCM in cathode pores, they represent a finished semipermeable oxygen membrane element.

The essential electrode and oxide layer features in the FIGS. 3 through 10 are shown much enlarged for clarity and schematic representation only. FIGS. 3 through 6 describe schematically and as examples only the preferred embodiments of the process with respect to the methods of supplying the oxygen reactants for the deposition of GOIC layers.

Figure 3:
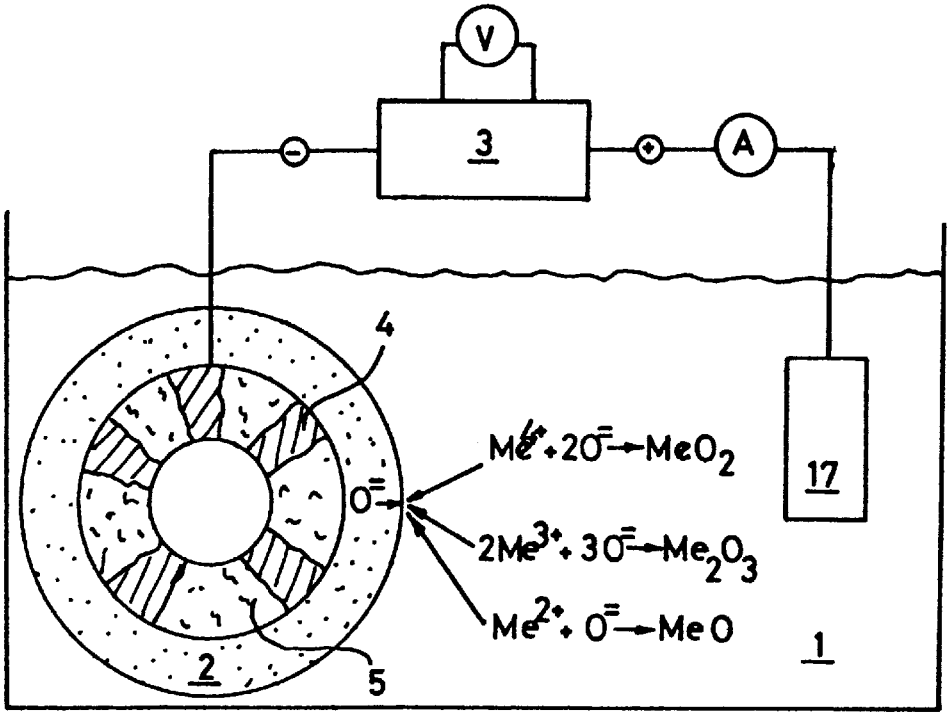
FIG. 3 is a schematic representation of oxygen supply for oxide layer growth from oxides at walls of tubular cathodes, in cross section.

FIG. 3 shows the basic COD electrochemical reactions of four-, three-, and two-valent metal cations, dissolved in the electrochemical salt bath 1, with oxygen ions which migrate through a growing GOIC layer 2 in a DC voltage gradient, which is controlled by a DC power supply 3, to form the respective metal oxide. The simultaneous reactions of mixed metal cations of different valencies with oxygen ions leads mostly to the formation of mixed oxide layers of several metal element. For instance, the simultaneous formation of oxides of two or more metal elements can lead to the formation of solid solutions of oxides, such as in the formation of YSZ layers by the following cathodic reactions:

$$Zr^{4+}+2O^{=}\rightarrow ZrO_2, \quad (1)$$

$$2Y^{3+}+2O^{-}\rightarrow Y_2O_3, \quad (2)$$

The oxides of zirconium and yttrium, as produced by the reactions (1) and (2) form a solid oxide solution of YSZ at the instance of their formation. The addition of three-valent-metal oxides to four-valent-metal oxides is an often used "doping" method to modify and improve oxygen ion conduction and electronic conduction of the host oxide. Preferred host oxides are zirconia, hafnia, and ceria. The preferred doping-oxides for zirconia and hafnia are the oxides of the elements calcium, magnesium, scandium, yttriun, cerium, praseodymium, samarium, europium, ytterbium, aluminum, and indium. Preferred doping oxides for ceria are the oxides of the elements calcium, magnesium, strontium, barium, scandium, ytterbium, lanthanum, praseodymium, neodymium, samarium, europium, gadolinium, manganese, cobalt, iron, nickel, copper, chromium, vanadium, titanium, zirconium, and hafnium.

Doped bismuth oxide ($Bi_2O_3$) is another oxygen ion conductor and can also be produced by the COD process for depositing GOIC layers on cathodes. Preferred doping oxides for increasing the oxygen ion conduction and phase stability of bismuth oxide are the oxides of the elements calcium, magnesium, strontium, barium, scandium, yttrium, lanthanum, cerium, praseodymium, neodymium, samarium, gadolinium, dysprosium, erbium, ytterbium, zirconium, hafnium, titanium, vanadium, and copper.

It is obvious that the halides of all of the above mentioned elements can be dissolved as halides in the molten salt electrolyte bath of the COD process to undergo equivalent electrochemical cathodic reactions as shown in reactions (1) and (2) to result in GOIC layer formation.

FIG. 3 shows also a method for generating oxygen ions for delivery to the oxide layer growth region which is located at the interface of the oxide layer with the molten salt electrolyte bath, where the dissolved metal cations react with the emanating oxygen ions to form GOIC layers. The oxygen can be obtained from oxygen reactants 4 which are donating oxides that have been deposited into the pores of a porous cathode specifically for the purpose of oxygen donation. Also, oxygen can be obtained from the bulk oxide cathode material 5 itself in limited quantities to provide the oxygen for GOIC layer growth. In both cases, the formation of oxygen ions can be described by the reaction:

$$Me_xO_y+2ne^{-}\rightarrow Me_xO_{y-n}+nO^{=} \quad (3)$$

Oxides that are used as the oxygen donating reactants, whether in the form of deposits in cathode pores or as cathode materials themselves, are preferably the oxides of transition elements and mixed oxides of these elements, namely, the oxides of chromium, manganese, iron, cobalt, nickel, palladium, copper, praseodymium, zinc, and indium. Also complex oxides of alkaline earth elements and transition elements, preferably, oxides belonging to the group called perovskites, are preferred as oxygen donating reactants, as well as cathode materials . An example of this group of oxides with the general chemical formula $ABO_3$ are strontium ferrite ($SrFeO_3$) based doped oxides, where the element A (Sr) can be replaced, partially or in whole, by other earth alkali metals such as calcium and barium or by rare earth elements such as yttrium, lanthanum, cerium, praseodymium, neodymium, samarium, gadolinium, and ytterbium. The element B (Fe) can equally be replaced, partially or in whole, by other elements, preferably by elements of the transition elements, such as cobalt, nickel, manganese, copper, zinc, magnesium, chromium, titanium, zirconium, niobium, vanadium, tantalum, and aluminum.

Another example of an oxygen donating reactant is doped lanthanum ($LaMnO_3$) which is also a perovskite of which the element A (La) can be replaced, similarly as in the case of strontium ferrite, with members of the group of earth alkali elements and rare earth elements. The element B can be replaced also, preferably as cited in the case of strontium ferrite, by elements of the group of transition elements. Cathode structures are preferably made from lanthanum manganite materials in powder form of the doped oxide. The powders are compacted by various known techniques such as pressing, extrusion, slip casting, and others, and are then sintered into porous shapes, preferably tubes and channels.

Figure 4:
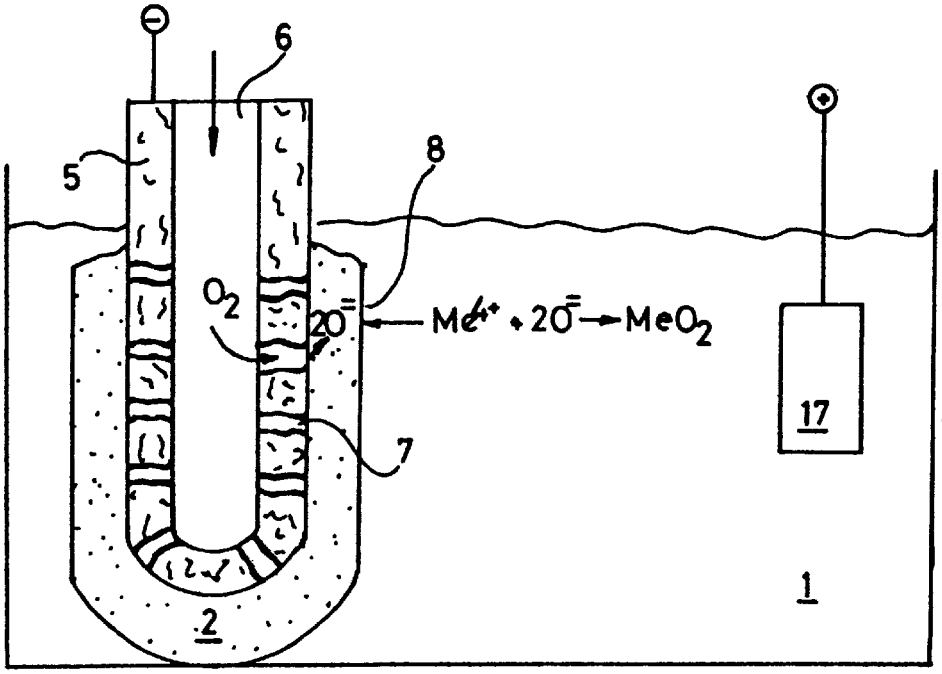
FIG. 4 is a schematic representation of oxygen supply for oxide layer growth from oxygen gas which permeates the pores of tubular cathodes, in axial section.

FIG. 4 shows a preferred method of oxygen reactants delivery to cathodes 5 that uses oxygen gas 6, pure or diluted with inert gases, such as nitrogen, helium, and argon, whereby oxygen gas is reduced to oxygen ions within the pores 7 of the cathode as described in reaction (4). The oxygen ions are then delivered to the site of oxide growth 8.

$$O_2+4e^{-}\rightarrow 2O^{=} \quad (4)$$

This method is successfully applied to thicker GOIC layers where large supply of oxygen reactant is required.

Figure 5:
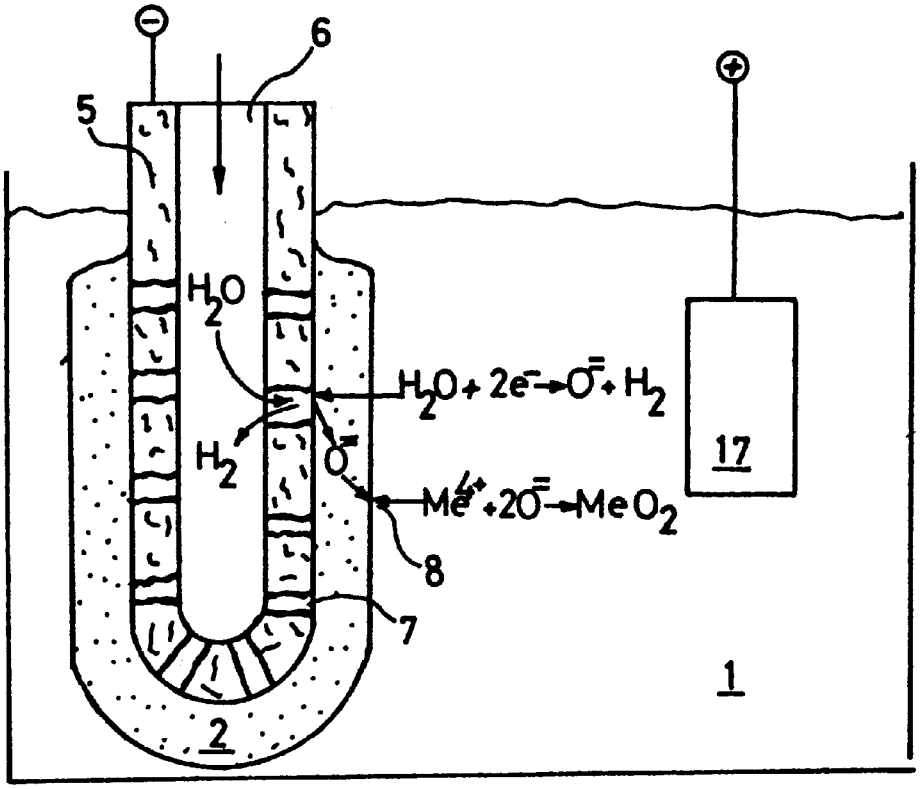
FIG. 5 is a schematic representation of oxygen supply for oxide layer growth from gaseous oxygen containing compounds which permeate the pores of tubular cathodes, in axial section.

FIG. 5 shows a method, similar to the method shown in FIG. 4. Here, the gaseous oxygen reactant is water vapor 6, preferably diluted with nitrogen or argon. Oxygen ions are produced by reaction (5) and delivered to the site of oxide growth 8.

$$H_2O+2e^{-}\rightarrow O^{=}+H_2 \quad (5)$$

Other oxygen containing reactant gases, such as carbon dioxide ($CO_2$), nitrogen oxides ($N_2O$, NO), and sulfur dioxide ($SO_2$) can be used in equivalent electrochemical reaction schemes as shown in the case of water vapor, to deliver oxygen ions for GOIC layer growth.

A preferred oxygen reactants delivery method is a combination of the methods described in FIGS. 4 and 5, where the oxygen reactants are gaseous mixtures of two or more oxygen containing species which are preferably diluted with inert gases such as nitrogen or argon in order to achieve a maximum control of the nucleation and growth phases of the cathodically deposited GOIC layers.

Figure 6:
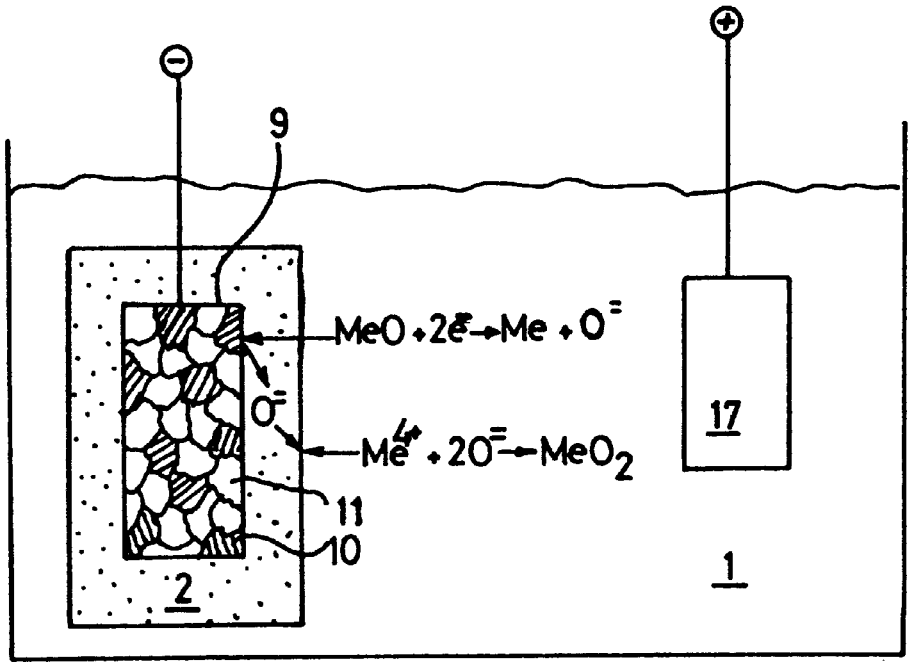
FIG. 6 is a schematic representation of oxygen supply for oxide layer growth from a metal/metal oxide composite cathode as support for oxide layers.

FIG. 6 shows a method where a metal/metal oxide composite 9 is used as a cathode for GOIC layers 2. Here, the oxygen reactant is the respective metal oxide 10, which is reduced electrochemically to metal 11, when donating its oxygen for the oxygen ion supply for growing GOIC layers, according to reaction (6).

$$MeO+2e^- \rightarrow Me+O^- \quad (6)$$

With this method oxygen may be supplied by using metal/metal oxide mixtures of copper/copper oxide, nickel/nickel oxide, iron/iron oxide, manganese/manganese oxide, chromium/chromium oxide, and palladium/palladium oxide.

Figure 7:
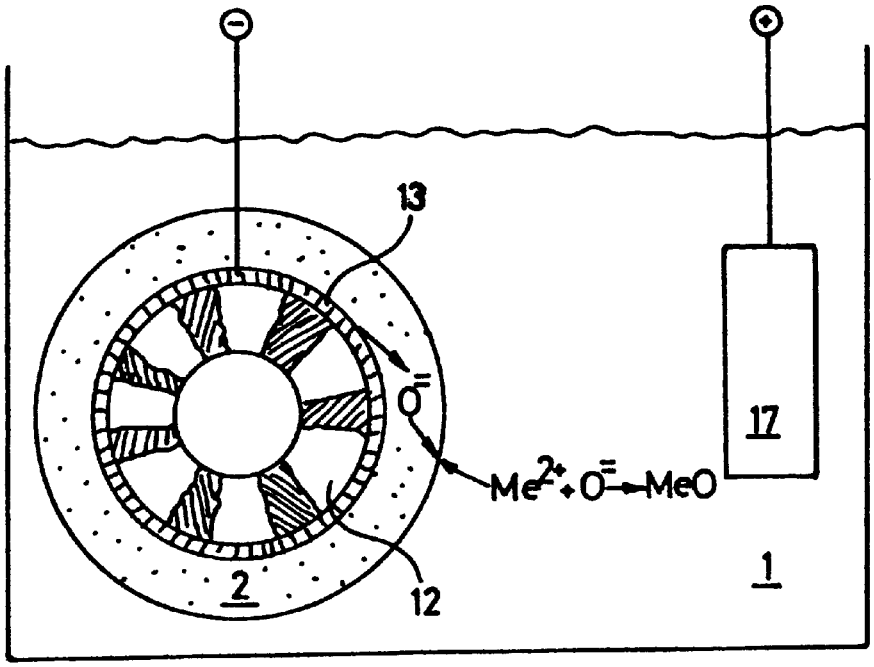
FIG. 7 is a schematic representation of the COD process for growth of oxide layers onto electrically insulating tubular porous support structures, in cross section.

FIG. 7 shows a method to fabricate GOIC layers over a porous support structure 12 which is electrically insulating. Such porous structures must first be coated with an electronically conducting and porous layer 13 consisting of metals or oxides. For this purpose metals like platinum, palladium, iron, cobalt, nickel, silver, and copper can be used Conducting oxides include tin-doped indium oxide, antimony-doped tin oxide, doped lanthanum manganite, doped lanthanum chromite, and, in general, doped complex oxides of the group of oxides with the perovskite crystal structure having the general chemical formula $ABO_3$, where the element A consists of individual members or mixed members of the element groups of alkaline earth elements, including calcium, strontium, and barium, as well as rare earth elements, including scandium, yttrium, lanthanum, cerium, and praseodymium, and where the element B consists of individual members or mixed members of the group of transition elements, preferably, iron, cobalt, nickel, titanium, and chromium.

The so formed conducting layer 13 over the porous insulator structure represent the cathode in the COD process and is connected to the negative terminal of the DC power supply. The method of oxygen reactants supply for oxygen ion formation for the GOIC layer growth is equivalent to the methods shown and explained in FIGS. 3, 4, and 5. The method according to FIG. 7 is used preferably for the fabrication of oxygen sensor structures wherein the electronically conducting thin porous layer is used as an electrode to the thin GOIC layer, both of which are mechanically supported by the porous insulator structure, which is preferably made of an oxide material, such as alumina, stabilized zirconia, ceria, lanthanum aluminate, and magnesia.

Figure 8:
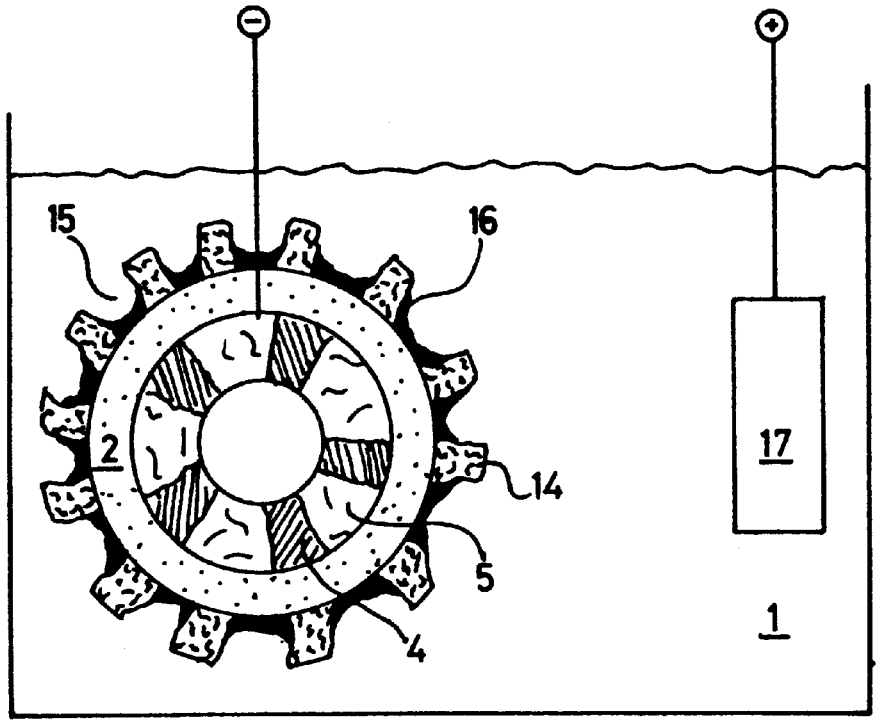
FIG. 8 is a schematic representation of the COD process for bonding porous electrode layers onto tubular oxide layers, in cross section.

FIG. 8 shows a method of bonding porous layers of materials 14, which are non-reactive with the electrochemical molten salt bath and the dissolved metal halides therein, unto GOIC layers 2, by the process of, first, attaching such porous materials layers to previously grown GOIC layers sufficiently to endure the exposure to the electrolyte bath 1 without separation, second, start the COD process by which the growing oxides penetrate the pores 15 of the previously applied porous materials layer 14 while growing an oxide skeleton 16 within the pores of the applied materials layer, thereby attaching it to the GOIC layer. The oxide skeleton can be of the same composition as the underlaying oxide layer or be of a different composition to better suit requirements for the bonded porous layer.

An example of this method is the attachment of lightly sintered layers of copper metal powders to GOIC layers and bonding them firmly. Porous layers of nickel, iron, cobalt, platinum, and other metals can be attached, like copper, for electrodes unto GOIC layers. Insulating oxides as well as carbides, borides, nitrides, silicides, and similar, can be bonded by this method.

Figure 9:
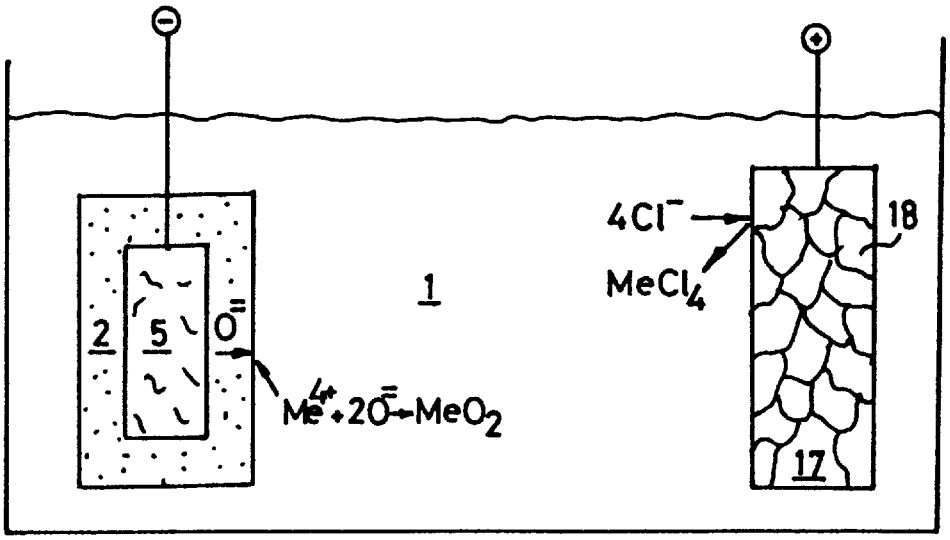
FIG. 9 is a schematic representation of anodic regeneration of metal halides from metallic elements.

FIG. 9 shows the reactions at the anode 17 where, during the COD process, chloride ions (representing also other halide ions) loose their electrons to the electronically conducting anode while forming free elemental chlorine which reacts instantaneously with the metallic elements 18 which is supplied at the anode to regenerate the metal elements halides that have been consumed from the electrochemical molten salt bath by the formation of the GOIC layers. The anodic reaction sequence is seen in reactions (7) and (8).

$$4Cl^- \rightarrow 4[Cl]+4e^-, \quad (7)$$

$$4[Cl]+Me \rightarrow MeCl_4. \quad (8)$$

The regenerated chlorides dissolve immediately in the salt bath. The reactions (7) and (8) are a typical example for the regeneration of four valent zirconium cations that would be consumed in the formation of zirconia based GOIC layers.

Figure 10:
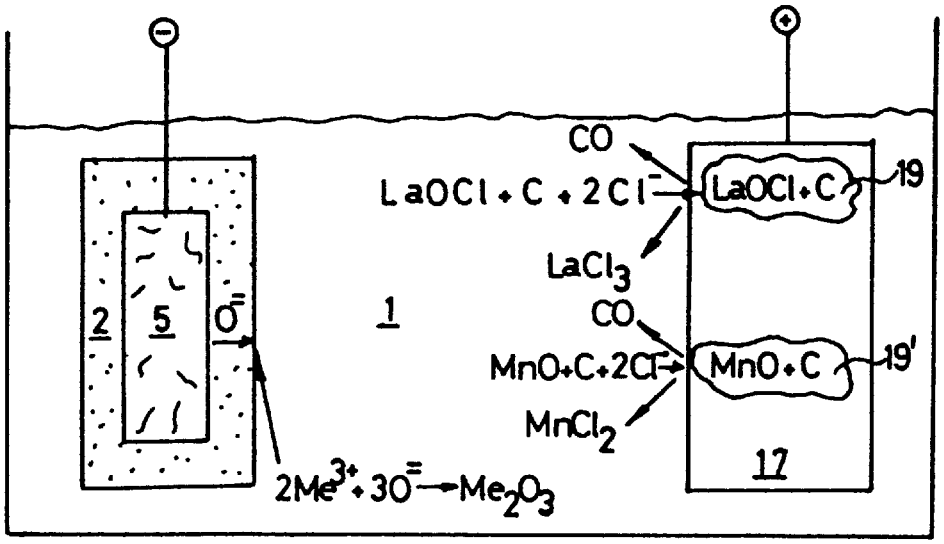
FIG. 10 is a schematic representation of anodic regeneration of metal halides from metal compounds with carbon

FIG. 10 shows the reaction at the anode 17 for the regeneration of lanthanum and manganese cations that are consumed during the cathodic formation of complex oxide lanthanum manganite based GOIC layers 2 from chloride (halide) melts, where the anode contains metal element compounds 19 which are reacted to regenerate the consumed metal element chlorides (halides) from the melt. The lanthanum element is contained at the anode in the form of lanthanum oxychloride (oxyhalide) in intimate mixture with carbon and reacts with the anodically formed free elemental chlorine (elemental halide) according to reaction (9) to regenerate lanthanum chloride.

$$LaOCl+C+2[Cl] \rightarrow LaCl_3+CO \quad (9)$$

The manganese element is contained at the anode as oxides of the two- or three-valent manganese in intimate mixture with carbon and also in intimate contact and proportional ratio with the lanthanum oxychloride/carbon mixture. The anodically formed free elemental chlorine reacts according to reaction (10) to regenerate manganese chloride.

$$MnO+C+2[Cl] \rightarrow MnCl_2+CO \quad (10)$$

Both chlorides are regenerated simultaneously at the anode and are dissolved in the salt bath.

The formation of the complex lanthanum manganite in the perovskite crystal structure is thermodynamically favored over the formation of the separate oxides of lanthanum and manganese. Doping of the lanthanum manganite oxide with alkaline earth, as well as rare earth elements can be accomplished by adding the doping element chlorides (halides) to the molten salt electrochemical bath and regenerating them at the anode in equivalent methods as shown for the chlorides (halides) of lanthanum and manganese.

It is obvious to persons of ordinary skill to fabricate GOIC layers of other oxides having the perovskite or the fluorite or another crystal structure, which can support electrical conduction via oxygen ions.

The generated carbon monoxide gas, formed at the anode, escapes from the molten salt bath and is removed from the inert gas atmosphere of the COD generator in a gas recirculation and purification loop to remove excessive contaminants such as small amounts of vaporized and condensed halides, particulate matter, oxygen containing gases, as well as carbon monoxide, by standard gas purification means.

Under constant COD conditions, the consumable, anodes as shown by example only of FIGS. 9 and 10, and used for all methods shown in FIGS. 1 through 10, must be replaced periodically with new ones.

The composition of the molten salt electrolysis bath for the COD process, as described for the preferred process methods and shown schematically and by example only in FIGS. 1 through 10, can vary widely and can be adapted to the needs of various GOIC compositions if necessary. The molten salt bath compositions are preferably those of eutectic mixtures of alkali metal halides, such as fluorides, chlorides, bromides, iodides of the elements lithium, sodium, potassium, rubidium and cesium. The binary eutectic melt of the chlorides of lithium and potassium with 42 mol % KCl and a melting point of approximately 350° C. is the preferred salt bath. Binary, ternary, as well as quaternary mixtures of alkali metal halides can be used, as well as mixtures between different alkaline elements in the form of chlorides, fluorides, bromides and iodides.

The metal element halides, which are dissolved in the molten salt electrolyte bath and which provide the metal element cations at the cathode to form the GOIC layers, are preferably chlorides, but they can be in the form of fluorides, bromides, and iodides also.

The preferred material for the molten salt bath container is graphite, other materials, such as alumina, silicon carbide, silica, mullite, and metals such as copper, nickel, iron and stainless steel are also possible material choices.

The rate of oxide layer growth by the COD process is controlled by an external DC power supply which can operate in a constant current as well as in a constant voltage mode. Its positive terminal is connected to the anodes and its negative terminal is connected to the cathodes of the COD electrochemical molten salt bath.

After removal of the cathodes from the salt bath they are cooled and removed from the COD reactor via gas lock chambers. Minor amounts of occluded salts in pores and adherent to the surface of cathodes are removed in a subsequent water leaching process which includes the constant flow of water by pumping it through cathode channels and over cathode surfaces. The consumption of water is minimal when ion exchange resins are used for salt recovery from the solution by well established methods. The deposited GOIC layers and porous support structures are then dried preferably in heated air.

The preferred thickness of GOIC layers, as produced by the COD process, is in the range of a few micrometers to fifty micrometers, however, it is not limited to this range. The porous support structures for the GOIC layers can be from fractions of a millimeter up to several centimeters in thickness. The average open porosity of the cathode support structures can vary between 1% and 90% by volume, it lies preferrably between 20% and 50% by volume.The porosity of the support structures is designed to having layers with 0.1 to 100 micrometer large pores next to the GOIC layers, and whereby the wall thickness between pores, called the web thickness, is in the range of 1 to 100 micrometers in thickness.

OPERATION

The execution of operations for the COD process according to this invention is described for three examples of GOIC layer deposition onto cathodes.

EXAMPLE 1

For the fabrication of an yttria-dope ceria layer over a porous lanthanum manganite cathode support, the following major process steps are shown.

A porous sintered support cathode in the form of a pressed and sintered pellet of calcia-doped lanthanum manganite ($La_{0.8}Ca_{0.2}MnO_3$) having a porosity of approximately 40% by volume, is vacuum impregnated with a concentrated solution of praseodymium nitrate in water. The impregnated solution is dried in warm air and the nitrates are thermally decomposed to praseodymium oxide by heating the cathode to 400° C. Loosely attached praseodymium oxide is removed from the pellet by brushing and ultrasonic cleaning methods using a water rinse for debris removal. The dried cathode pellet which has a diameter of approximately 15 mm and a thickness of approximately 2 mm is electrically contacted by a metal wire such as nickel, copper, platinum, or similar.

A tubular graphite crucible of 19 mm inner diameter, 2 mm wall thickness, and 100 mm length is filled to half of its volume with the melted binary eutectic mixture of lithium chloride and potassium chloride and containing dissolved cerium chloride (2% by weight) and dissolved yttrium chloride (0.5% by weight). The graphite crucible with melt is contained in a 25 mm open diameter VYCOR glass tube which is positioned vertically in a tube furnace cavity. Dry and oxygen free nitrogen is used as a cover gas.

A pressed pellet of yttria-doped ceria powder in mixture with approximately 60% by volume of lamp black is submerged in the salt bath and is in electrical contact with the graphite crucible at the bottom, the pellet represents the active anode for the regeneration of cerium and yttrium cations. The crucible is contacted via nickel wire to the positive terminal of a DC power supply. The cathode pellet which is positioned over the salt bath is connected to the negative terminal of the DC power supply. When the arrangement is equilibrated at 420° C. the cathode is fully submerged in the molten salt electrolyte. The current flow is adjusted and raised within 5 minutes to 35 milliamperes, it is maintained at this level for approximately 30 minutes. The cathode pellet is removed from the melt and cooled. The pellet is then rinsed in water and the deposited oxide is removed from one pellet side by grinding to aid the water leaching of trapped salt melt from the pores of the cathode. The layer of the yttria doped oxygen ion conducting ceria is approximately 10 micrometer in thickness.

EXAMPLE 2

The same electrochemical salt bath, as well as the same arrangement is used for the deposition of yttria doped ceria over a copper/copper oxide cathode of similar size as in example 1. The pressed cathode pellet consists of approximately 30% by volume of copper oxide ($Cu_2O$). The COD growth process is controlled by a similar current flow of 30 to 40 milliampere for 30 minutes. The resulting yttria doped ceria layer, produced by COD, is approximately 10 micrometer in thickness. The occluded chloride melt is leached with water from the cathode pores after partial removal of the deposited oxide by grinding.

EXAMPLE 3

This example shows the method of the COD process for the deposition of YSZ layers onto porous doped lanthanum manganite tubes.

A eutectic salt melt of lithium chloride and potassium chloride is prepared under nitrogen cover gas with dissolved zirconium tetrachloride (~2% by weight) and dissolved yttrium trichloride (~0.5% by weight). A pressed pellet of fine YSZ powder in intimate mixture with 50% by volume of lamp black is submersed in the salt bath and is in electrical contact with the graphite crucible. This pellet is the active anode for regeneration of yttrium chloride and zirconium chloride in the salt bath.

A closed-end tube of 40 mm length, made of extruded and sintered doped lanthanum manganite ($La_{0.8}Ca_{0.2}MnO_3$), is attached with a melted PYREX glass-type sealant to a stainless steel tube which serves as electrical contact to the open end of the porous lanthanum manganite tubular cathode, as well as to provide for gas flow means of oxygen reactants gas on the cathode tube inside. The cathode tube outer and inner diameter dimensions are 6 and 3 mm respectively.

In an arrangement, similar to the one described in examples 1 and 2, the cathode tube is positioned over the molten salt bath in the graphite crucible and is purged on the inside with nitrogen cover gas. When the cathode and salt bath have reached a temperature of approximately 430° C. the cathode tube is submerged quickly into the melt while changing the gas composition at the cathode tube inside to 2% oxygen and 0.3% water vapor in nitrogen and raising the gas pressure within the cathode tube without percolating the gas into the melt. The pressurization is done in order to avoid excessive salt impregnation of the cathode pores. The required cathode gas pressure must be determined experimentally and depends on pore size and wetting ability of the cathode material.

After the cathode tube is submersed, the electric current flow is established immediately and raised within 5 minutes to approximately 70 to 80 milliamperes while the oxygen reactants gas flow within the cathode tube is adjusted to approximately 40 milliliters per minute. The current flow is maintained for 30 minutes after which the cathode tube is withdrawn from the salt bath, cooled, and water leached on the inside and outside by flowing water. The deposited YSZ oxide layer is attached to the porous lanthanum manganite tube outside only in a thickness of approximately 10 to 12 micrometers.

EXAMPLE 4

This example demonstrates the COD process for the fabrication of lanthanum manganite layers over porous lanthanum manganite cathodes with impregnated praseodymium oxide as oxygen donating reactant.

The cathode is prepared in the same manner as described in example 1. The binary eutectic salt melt of lithium chloride and potassium chloride contains approximately 2% by weight of lanthanum trichloride and 2% by weight of manganese dichloride. The anode is made of equal molar mixtures of lanthanum oxide ($La_2O_3$) and manganese oxide ($Mn_2O_3$) with 60% by volume of lamp black which is pressed into pellet form. The pellet represents the active anode which is submersed in the molten salt bath and is in electrical contact with the graphite crucible, it regenerates lanthanum and manganese cations.

The cathode is positioned over the molten salt, the cathode and melt crucible are connected to the negative and positive terminals of the DC power supply, respectively. When the arrangement has reached an equilibrium temperature of 420° C. the cathode is submersed into the salt melt and the current flow is increased to 35 to 40 milliamperes within 5 minutes. The current flow is maintained for further 30 minutes after which the cathode is removed from the melt, cooled, and water-leached after partly grinding the oxide deposit away for effective removal of trapped salt bath residue in cathode pores. The resulting oxide deposit thickness is nearly 10 micrometers.

What is claimed is:

1. An electrochemical process for forming oxygen ion conducting oxide layers onto the surface of oxygen reactants containing cathodes, comprising the steps of: placing said cathodes in an electrolyte bath of melted alkali element halides having metal halides dissolved therein, arranging in said bath anodes made of materials containing metal elements comprising the metal elements of said dissolved metal halides, electrically connecting an external DC voltage source to said anodes and said cathodes such that said anodes are connected to the positive terminal and said cathodes are connected to the negative terminal of said voltage source, passing a DC current between said anodes and said cathodes thereby forming said oxygen ion conducting oxide layers of metals from said dissolved metal halides on said cathodes by removal of cations from said dissolved metal halides, maintaining said oxygen reactants at said cathodes separated from said cations of said dissolved metal halides by said oxide layers whereby said oxygen reactants provide for oxygen ions diffusing through said oxide layers and reacting with said cations of said dissolved metal halides resulting in growth of said oxide layers, and simultaneously reacting halide anions with said anodes so as to regenerate said dissolved metal halides and said cations removed from said electrolyte bath by the growth of said oxide layers.

2. An electrochemical process as recited in claim 1, wherein said alkali element halides are chlorides.

3. An electrochemical process as recited in claim 1, wherein said alkali element of said alkali element halides consists of at least one of lithium, sodium, potassium, rubidium, and cesium.

4. An electrochemical process as recited in claim 1, wherein said halides of said alkali element halides consist of at least one of fluorides, chlorides, bromides, and iodides.

5. An electrochemical process as recited in claim 1, wherein said dissolved metal halides are halides of metal elements consisting of at least one of magnesium, calcium, strontium, barium, scandium, yttrium, lanthanum, cerium, praseodymium, neodymium, samarium, gadolinium, erbium, ytterbium, titanium, zirconium, hafnium, thorium, bismuth, manganese, iron, cobalt, nickel, copper, silver, zinc, chromium, vanadium, niobium, aluminum, gallium, and indium.

6. An electrochemical process as recited in claim 1, wherein said dissolved metal halides are halides consisting of at least one of fluorides, chlorides, bromides, and iodides.

7. An electrochemical process as recited in claim 1, wherein said oxygen ion conducting oxide is stabilized zirconia.

8. An electrochemical process as recited in claim 7, wherein said stabilized zirconia is a solid solution with oxides of elements consisting of at least one of magnesium, calcium, scandium, yttrium, cerium, praseodymium, neodymium, samarium, europium, ytterbium, aluminum, hafnium, and indium.

9. An electrochemical process as recited in claim 1, wherein said oxygen ion conducting oxide is cerium oxide doped with oxides of foreign elements.

10. An electrochemical process as recited in claim 9, wherein said foreign elements consist of at least one of magnesium, calcium, strontium, barium, scandium, yttrium, ytterbium, lanthanum, praseodymium, neodymium, samarium, gadolinium, manganese, cobalt, iron, nickel, copper, chromium, vanadium, titanium, zirconium, and hafnium.

11. An electrochemical process as recited in claim 1, wherein said oxygen ion conducting oxide is hafnium oxide doped with oxides of foreign elements.

12. An electrochemical process as recited in claim 11, wherein said foreign elements consist of at least one of magnesium, calcium, strontium, scandium, yttrium, cerium, samarium, gadolinium, ytterbium, zirconium, and aluminum.

13. An electrochemical process as recited in claim 1, wherein said oxygen ion conducting oxide is bismuth oxide doped with oxides of foreign elements.

14. An electrochemical process as recited in claim 13, wherein said foreign elements consist of at least one of magnesium, calcium, strontium, barium, scandium, yttrium, lanthanum, cerium, praseodymium, neodymium, samarium, gadolinium, dysprosium, erbium, ytterbium, zirconium, hafnium, vanadium, and copper.

15. An electrochemical process as recited in claim 1 wherein said oxygen ion conducting oxide is a complex oxide composed of elements, having the general of $ABO_3$, where A are elements consisting of at least one of magnesium, calcium, strontium, barium, yttrium, scandium, lanthanum, cerium, praseodymium, neodymium, samarium, gadolinium, ytterbium, and where B are elements consisting of at least one of manganese, iron, cobalt, nickel, copper, aluminum, gallium, indium, chromium, titanium, zirconium, hafnium, vanadium, niobium, and tantalum.

16. An electrochemical process as recited in claim 1, wherein said molten salt electrolyte bath is contained in a graphite vessel.

17. An electrochemical process as recited in claim 1, wherein said molten salt electrolyte bath is contained in containers of metals.

18. An electrochemical process as recited in claim 17, wherein said metals comprise iron, cobalt, nickel, copper, and stainless steel.

19. An electrochemical process as recited in claim 1, wherein said electrochemical process is executed in an inert gas atmosphere.

20. An electrochemical process as recited in claim 1, wherein said cathodes are made of electronically conducting oxides having the general formula of $ABO_3$, where A are elements consisting of at least one of calcium, strontium, barium, yttrium, lanthanum, cerium, praseodymium, neodymium, samarium, gadolinium, and ytterbium, and where B are elements consisting of at least one of manganese, iron, cobalt, nickel, copper, aluminum, magnesium, zinc, chromium, titaniumn, zirconium, vanadium, niobium, and tantalum.

21. An electrochemical process as recited in claim 1, wherein said cathodes are made of electronically insulating oxides with surface layers of electronic conductors.

22. An electrochemical process as recited in claim 1, wherein said oxygen reactants are oxides of elements comprising the group of copper, iron, nickel, cobalt, manganese, chromium, palladium, and praseodymium, zinc, and indium.

23. An electrochemical process as recited in claim 1, wherein said oxygen reactants are inert-gas-diluted oxygen gas mixtures.

24. An electrochemical process as recited in claim 1, wherein said oxygen reactants are inert-gas-diluted gaseous oxides, comprising water vapor ($H_2O$), carbon dioxide ($CO_2$), nitrogen oxides ($N_2O$), and sulfur dioxide ($SO_2$).

25. An electrochemical process as recited in claim 1, wherein said oxygen reactants are inert-gas-diluted gas mixtures consisting of at least one of oxygen, water vapor, carbon dioxide, nitrous oxide, and sulfur dioxide.

26. An electrochemical process as recited in claim 1, wherein said anodes contain metals of said dissolved metal halides as a source for the anodic regeneration of said dissolved metal halides.

27. An electrochemical process as recited in claim 1, wherein said anodes contain metal oxides/carbon mixtures as a source for the anodic regeneration of said dissolved metal halides.

28. An electrochemical process as recited in claim 1, wherein said anode contains metal oxyhalides/carbon mixtures as a source for the anodic regeneration of said dissolved metal halides.

29. An electrochemical process as recited in claim 1, wherein said DC voltage source operates in the voltage control mode.

30. An electrochemical process as recited in claim 1, wherein said DC voltage source operates in the current control mode.

31. An electrochemical process as recited in claim 1, wherein layers of porous materials are mechanically bonded to said oxide layers by extending the growth of said oxide layers into the pores of said porous material layers.

32. An electrochemical process as recited in claim 1, wherein said electrochemical process is executed as a continuous process.

33. An electrochemical process as recited in claim 1, wherein said electrochemical process is executed as a batch process.

* * * * *